US010533466B2

(12) United States Patent
Hirschmann et al.

(10) Patent No.: US 10,533,466 B2
(45) Date of Patent: Jan. 14, 2020

(54) VARIABLE VALVE GEAR WITH BRAKING CAMS

(71) Applicant: MAN Truck & Bus AG, München (DE)

(72) Inventors: Steffen Hirschmann, Neustadt an der Aisch (DE); Thomas Malischewski, Heilsbronn (DE); Andreas Sommermann, Heilsbronn (DE); Jürgen Ritter, Nürnberg (DE)

(73) Assignee: MAN Truck & Bus AG, München (DE)

( * ) Notice: Subject to any disclaimer, the term of this patent is extended or adjusted under 35 U.S.C. 154(b) by 0 days.

(21) Appl. No.: 15/942,063

(22) Filed: Mar. 30, 2018

(65) Prior Publication Data

US 2018/0283242 A1 Oct. 4, 2018

(30) Foreign Application Priority Data

Mar. 31, 2017 (DE) ..... 10 2017 003 081

(51) Int. Cl.
*F01L 1/14* (2006.01)
*F01L 13/06* (2006.01)
(Continued)

(52) U.S. Cl.
CPC ..... *F01L 13/065* (2013.01); *F01L 1/053* (2013.01); *F01L 13/0036* (2013.01);
(Continued)

(58) Field of Classification Search
CPC ..... F01L 13/0036; F01L 13/06; F01L 1/185; F01L 13/065; F02D 13/04
(Continued)

(56) References Cited

U.S. PATENT DOCUMENTS 7,472,671 B2 * 1/2009 Elendt ..... F01L 1/053 123/90.16
7,823,559 B2 11/2010 Bohme et al.
8,474,424 B2 7/2013 Meintschel et al.

FOREIGN PATENT DOCUMENTS

DE 102006037396 A1 2/2008
DE 102007010155 A1 9/2008
(Continued)

OTHER PUBLICATIONS

German Search Report from German Patent and Trademark Office, relating to priority application DE10 2017 003 081.2, dated Feb. 15, 2018.

(Continued)

*Primary Examiner* — Ching Chang
(74) *Attorney, Agent, or Firm* — Maginot, Moore & Beck LLP

(57) ABSTRACT

A variable valve gear for an internal combustion engine of a motor vehicle has a cam carrier which is arranged on a camshaft in a manner which prevents relative rotation and allows axial movement between a first axial position and a second axial position and has a first cam and a second cam. The first cam is designed for a normal mode of the internal combustion engine, in which the first cam keeps a first exhaust valve open in the exhaust stroke. The second cam is designed for an engine braking mode of the internal combustion engine, in which the second cam initially keeps the first exhaust valve closed in the compression stroke and/or in the exhaust stroke and opens the first exhaust valve before reaching a top dead center of a piston movement.

20 Claims, 5 Drawing Sheets

(51) Int. Cl.

| | |
|---|---|
| ***F01L 13/00*** | (2006.01) |
| ***F01L 1/053*** | (2006.01) |
| ***F02D 13/04*** | (2006.01) |
| *F01L 1/18* | (2006.01) |

(52) U.S. Cl.
CPC ..... *F02D 13/04* (2013.01); *F01L 1/143* (2013.01); *F01L 1/185* (2013.01); *F01L 2001/0537* (2013.01); *F01L 2013/0052* (2013.01)

(58) Field of Classification Search
USPC ..... 123/90.16, 90.18, 90.39, 90.15
See application file for complete search history.

(56) References Cited

FOREIGN PATENT DOCUMENTS

| | | | |
|---|---|---|---|
| DE | 102007048915 | A1 | 4/2009 |
| DE | 102008029325 | A1 | 12/2009 |
| DE | 102010004591 | A1 | 7/2011 |
| DE | 102013019183 | A1 | 5/2015 |
| JP | 2017025827 | A | 2/2017 |
| WO | 2004083611 | A1 | 9/2004 |
| WO | 2014191385 | A1 | 12/2014 |
| WO | 2016123094 | A1 | 8/2016 |

OTHER PUBLICATIONS

European Patent Office Search Report Corresponding to European Patent Application No. 18 16 2016 (2 pages).

* cited by examiner

VARIABLE VALVE GEAR WITH BRAKING CAMS

The invention relates to a variable valve gear for an internal combustion engine of a motor vehicle, in particular of a commercial vehicle. The invention furthermore relates to a motor vehicle, in particular commercial vehicle, with a variable valve gear.

Valve-controlled internal combustion engines have one or more controllable inlet valves and exhaust valves per cylinder. Variable valve-controlling means permit flexible activation of the valves. As a result, the engine mode can be adapted, for example, to a specific load situation. An example of a variable valve gear is disclosed in WO 2004/083611 A1.

It is furthermore known that an internal combustion engine may also be used for braking a vehicle. An "engine brake" can, for example, reduce or prevent an undesirable acceleration during downhill stretches. Engine brakes of this type are suitable for prolonged braking durations and prolonged braking operations and at the same time in particular protect the actual brakes of the vehicle from overheating. This is relevant in particular for commercial vehicles which can have a high weight. A method for controlling the engine braking action of a valve-controlled internal combustion engine is disclosed in DE 10 2013 019 183 A1.

The invention is based on the object of providing a device for controlling an internal combustion engine, which device makes an engine brake possible by means of the internal combustion engine. The invention is in particular based on the object of developing a design which is favourable in terms of construction space.

The object is achieved by a variable valve gear according to the independent claim. Advantageous developments are specified in the dependent claims.

The variable valve gear for an internal combustion engine of a motor vehicle, in particular of a commercial vehicle, has a first exhaust valve. In addition, the valve gear has a camshaft and a cam carrier. The cam carrier is arranged on the camshaft in a manner which prevents relative rotation and allows axial movement between a first axial position and a second axial position. The cam carrier has a first cam and a second cam. The first cam and the second cam are arranged offset in a longitudinal direction of the camshaft. The valve gear furthermore has a first transmission device. In the first axial position of the cam carrier, the transmission device is in operative connection between the first cam and the first exhaust valve. In the second axial position of the cam carrier, the transmission device is in operative connection between the second cam and the first exhaust valve. The first cam is designed for a normal mode of the internal combustion engine, in which the first cam keeps the first exhaust valve open in the exhaust stroke. The second cam is designed for an engine braking mode of the internal combustion engine, in which the second cam initially keeps the first exhaust valve closed in the compression stroke and/or in the exhaust stroke and opens the first exhaust valve before reaching a top dead centre of a piston movement of a piston of the internal combustion engine.

Integrating the second cam as a braking cam in the variable valve gear permits the flexible and reaction-rapid activation of an engine brake during the operation of the internal combustion engine. If the first exhaust valve is opened by the second cam at the end of the compression stroke and/or at the end of the exhaust stroke, compression work is performed beforehand by the piston and brakes the crankshaft. By opening the first exhaust valve at the end of the corresponding stroke in the region of the top dead centre, the compressed air is pushed out into the exhaust gas system. If the exhaust valve is opened both at the end of the compression stroke and at the end of the exhaust stroke in the region of the top dead centre, said decompression can take place twice during a cycle. This efficient and reaction-rapid type of engine brake makes it optionally possible to dispense with other braking devices of the internal combustion engine, such as, for example, an engine brake flap, a charge air throttle valve and other sustained-action brakes, for example retarders.

It goes without saying that, while the second cam is in engagement with the first transmission device, the inlet valve or the inlet valves continue to open only during the inlet stroke. However, no fuel is introduced or mixture ignited.

The first cam and the second cam can have a different cam contour and/or can be arranged offset with respect to each other in a circumferential direction of the cam carrier.

In one exemplary embodiment, the cam carrier has a third cam which is designed in the manner of the first cam, and a cam-less section. The first cam, the second cam, the third cam and the cam-less section are arranged offset in a longitudinal direction of the camshaft. In particular, the first cam is adjacent to the second cam, and the third cam is adjacent to the cam-less section.

Integrating a third cam and the cam-less section makes it possible for a second exhaust valve to be able to be actuated differently in the braking mode than the first exhaust valve. By contrast, in the normal mode, the second exhaust valve can be actuated in the manner of the first exhaust valve since the third cam and the first cam are shaped identically.

The cam-less section is also referred to as zero cam. The cam-less section has a lateral cylinder surface without a raised portion for actuating the transmission device.

The valve gear preferably has a second exhaust valve which is in particular assigned to the same cylinder as the first exhaust valve, and a second transmission device. In the first axial position of the cam carrier, the second transmission device is in operative connection between the third cam and the second exhaust valve. In the second axial position of the cam carrier, the second transmission device keeps the second exhaust valve closed because of the design of the cam-less section. The cam-less section can be in engagement with or disengaged from the second transmission device here.

It goes without saying that, in the second axial position of the cam carrier, the second transmission device is not in operative connection with any other cam of the cam carrier This refinement has the advantage that only the first exhaust valve is used for the braking mode. The second exhaust valve remains closed during the entire cycle when the first exhaust valve is used for the braking mode. The loads on the variable valve gear can therefore be reduced. In particular, during opening of an exhaust valve counter to the pressure in the cylinder, large surface pressures arise between the cam and the contact surface of the transmission device. In refinements in which the two exhaust valves are actuated during the braking mode, the variable valve gear has to be designed to be correspondingly more robust.

In an alternative exemplary embodiment, the valve gear furthermore has a second exhaust valve which is assigned in particular to the same cylinder as the first exhaust valve. In the first axial position of the cam carrier, the first transmission device is additionally in operative connection between the first cam and the second exhaust valve, and, in the second axial position, is additionally in operative connection between the second cam and the second exhaust valve.

The first cam and the third cam can have an identical cam contour and/or can be arranged aligned (flush) with respect to each other in a circumferential direction of the cam carrier.

This refinement has the advantage that the two exhaust valves are used for the braking mode. The two exhaust valves are actuated via the same transmission device and the same cam.

In one variant embodiment, the cam carrier has a first engagement track for axially moving the cam carrier in a first direction. The first engagement track extends in particular in a spiral.

The first engagement track is designed in order, in engagement with an actuator, to move the cam carrier axially, for example from the first axial position to the second axial position or from the second axial position to the first axial position.

In a particularly preferred exemplary embodiment, the first engagement track is arranged in the cam-less section. Put in other words, the first engagement track extends in the zero cam.

Such a refinement affords the advantage that the cam-less section is firstly used for the axial movement. Secondly, the cam-less section ensures that the second exhaust valve is not opened in the engine braking mode. By means of the integration of functions, a construction space for the cam carrier can be reduced in size.

In a further variant embodiment, the first engagement track and/or the cam-less section is arranged between the first cam and the third cam or at one end of the cam carrier.

The arrangement of the cams, of the cam-less section and of the first engagement track can be adapted flexibly to the respective requirements.

In one embodiment, the cam carrier has a second engagement track for axially moving the cam carrier in a second direction which is opposed to the first direction. The second engagement track is arranged between the first cam and the third cam or at one end of the cam carrier. The second engagement track can extend in particular in a spiral.

The second engagement track is designed in order, in engagement with an actuator, to move the cam carrier axially, for example from the first axial position to the second axial position or from the second axial position to the first axial position.

The first and second engagement track provide a reliable possibility for displacing the cam carrier.

In a further embodiment, the variable valve gear has a first actuator which is designed to engage selectively with the first engagement track to move the cam carrier in the first direction. Alternatively or additionally, the variable valve gear has a second actuator which is designed to engage selectively with the second engagement track to move the cam carrier in the second direction.

In an advantageous manner, the camshaft has a locking device with an elastically prestressed element which, in the first axial position of the cam carrier, engages in a first recess in the cam carrier, and, in the second axial position of the cam carrier, engages in a second recess in the cam carrier.

The locking device has the advantage that the cam carrier can be fixed in the first and second axial position. The cam carrier therefore cannot be moved unintentionally along a longitudinal direction of the camshaft.

In a further exemplary embodiment, the first transmission device and/or the second transmission device is designed as a lever, in particular a rocker or a finger follower, or a tappet.

A finger follower can be used, for example, in an overhead camshaft. A rocker can be used, for example, in a bottom-mounted camshaft.

In a further variant embodiment, the camshaft is arranged as an overhead camshaft or a bottom-mounted camshaft. Alternatively or additionally, the camshaft is part of a double camshaft system which additionally has a further camshaft for actuating at least one inlet valve.

In a further embodiment, the cam shaft for the exhaust valve or the exhaust valves and/or the further camshaft for the inlet valve or the inlet valves can have a phase adjuster. The phase adjuster is designed to adjust a rotation angle of a camshaft relative to a rotation angle of a crankshaft. Thus, the phase adjuster can allow adjustment of the timings of the respective valves. The phase adjuster can be designed, for example, as a hydraulic phase adjuster, in particular as a rotary-actuator phase adjuster. Such an embodiment has the advantage that the flexibility of the system is further increased by means of the combination with the movable cam carrier.

The second cam is preferably designed in such a manner that the first exhaust valve opens between 100° crank angle and 60° crank angle before the top dead centre is reached. There can therefore be sufficient compression initially and also sufficient time remains to conduct the compressed air into the exhaust gas system.

It goes without saying that crank angle indicates an angle of a crankshaft.

Alternatively or additionally, after the opening in the exhaust stroke, the first exhaust valve closes in the region between the top dead centre and 30° crank angle after the top dead centre. Consequently, in the inlet stroke, intake air can flow through the open inlet valves into the cylinder. It is therefore not necessary to adapt the control of the inlet valves for the braking mode.

In addition or alternatively, after the opening in the compression stroke, the first exhaust valve closes in the region between the bottom dead centre and 30° crank angle after the bottom dead centre. Put in other words, the first exhaust valve is open in the engine braking mode during the expansion stroke. Air therefore flows back out of the exhaust gas system into the cylinder and is re-compressed in the subsequent stroke using compression work.

In a further variant embodiment, the second cam is designed in such a manner that, after the opening in the compression stroke, the first exhaust valve is opened with a greater valve lift than after the opening in the exhaust stroke.

Alternatively or additionally, the second cam is designed in such a manner that the first exhaust valve is opened with a smaller valve lift than in the case of the first cam.

The provision of multi-stage valve lifts which are smaller than the valve lifts during the normal mode reduces the load on the valve gear. In particular during the opening of an exhaust valve counter to the pressure in the cylinder, the valve gear is subjected to a heavy load.

In embodiments in which the second cam is also used for actuating the second exhaust valve, the statements herein relating to the action of the second cam on the first exhaust valve apply equally to the second exhaust valve.

In embodiments in which the third cam is used for actuating the second exhaust valve, the statements herein referring to the action of the first cam on the first exhaust valve apply equally to the third cam and the second exhaust valve.

The invention furthermore relates to a motor vehicle, in particular commercial vehicle, having the variable valve gear as herein disclosed.

The above-described preferred embodiments and features of the invention can be combined with one another in any desired manner. Further details and advantages of the invention are described below with reference to the attached drawings, in which.

Figure 1:
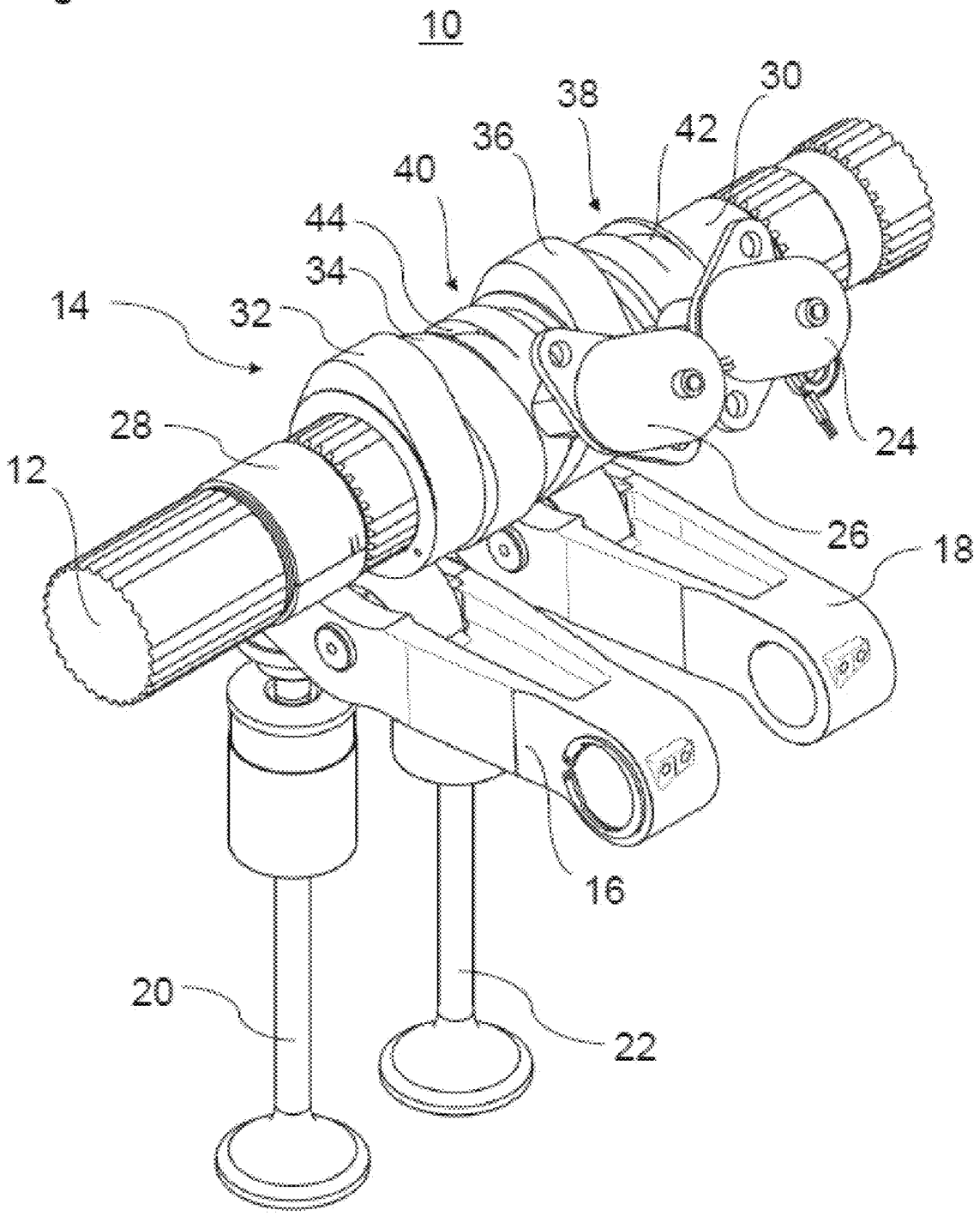
FIG. 1 shows a perspective view of an exemplary variable valve gear.
Figure 2:
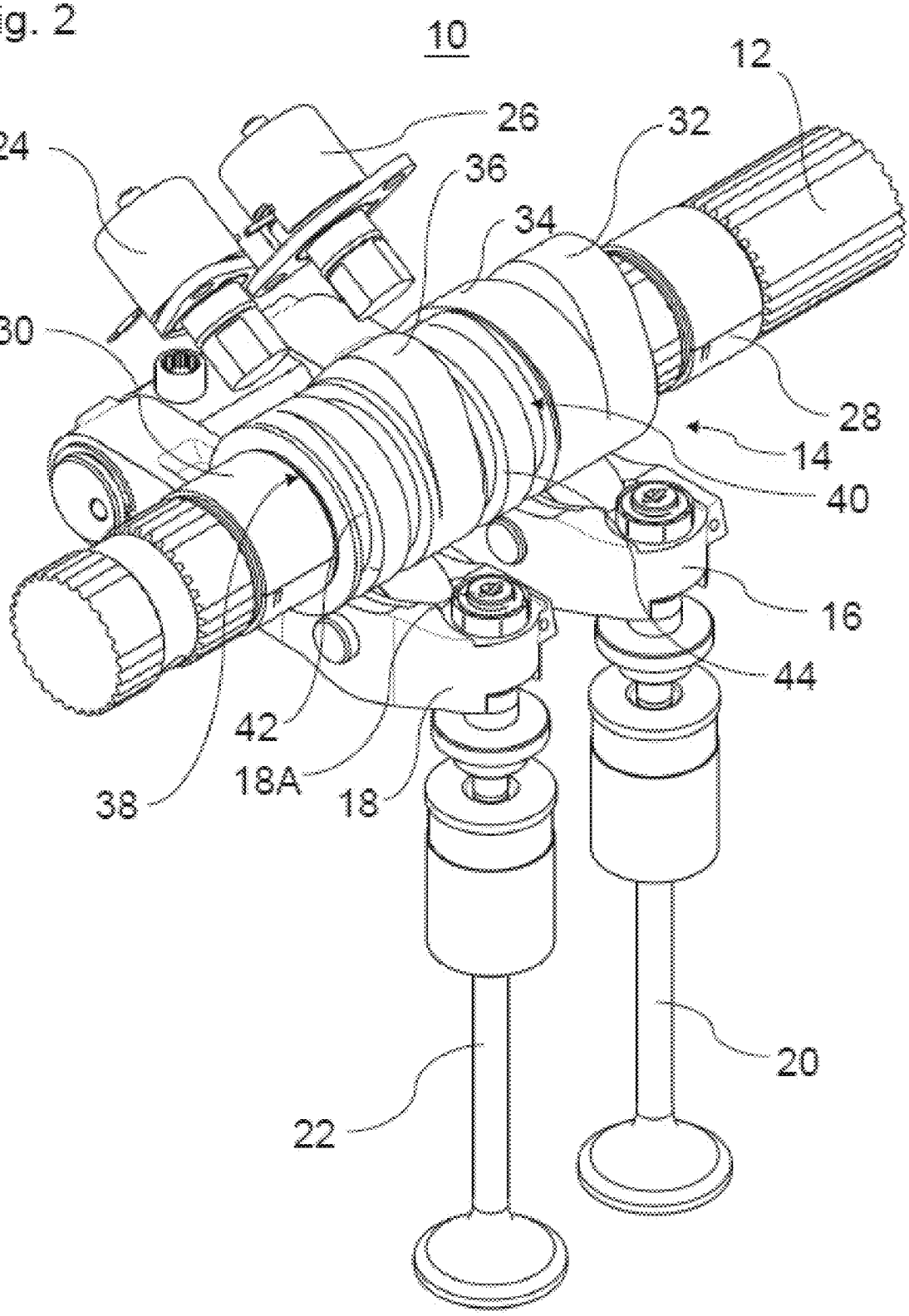
FIG. 2 shows a further perspective view of the exemplary variable valve gear.
Figure 3:
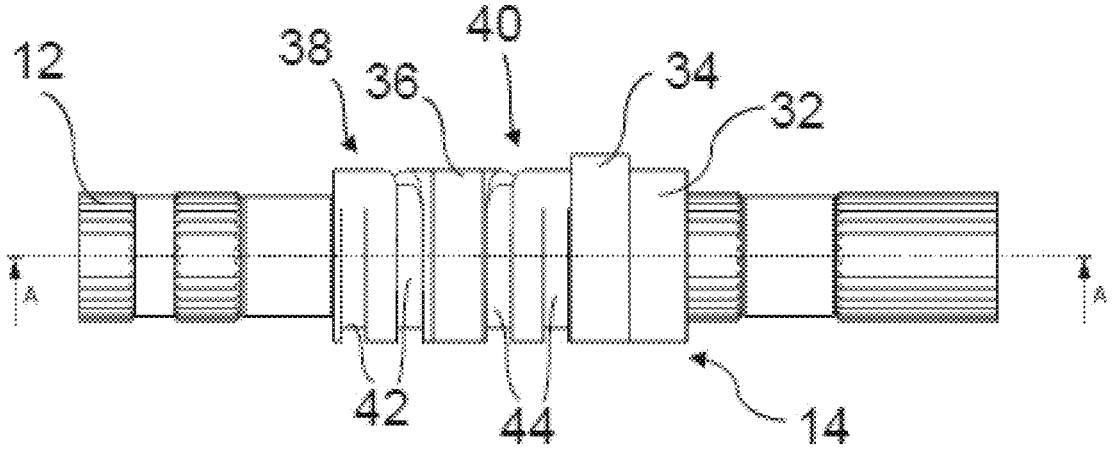
FIG. 3 shows a top view of a camshaft of the exemplary variable valve gear.

FIGS. 1 and 2 show a variable valve gear 10. The variable valve gear 10 has a camshaft 12 and a cam carrier 14. In addition, the variable valve gear 10 has a first and second transmission device 16 and 18 and also a first and second exhaust valve 20 and 22. The variable valve gear 10 also has the first actuator 24 and a second actuator 26.

The camshaft 12 is designed as an output camshaft which actuates exhaust valves 20 and 22. The camshaft 12 is part of a double camshaft system (not illustrated in detail) which additionally has an inlet camshaft (not illustrated) for actuating one or more inlet valves. The camshaft 12 is arranged together with the inlet camshaft as an overhead camshaft. The camshaft 12 and the inlet camshaft therefore form what is referred to as a DOHC system (double overhead camshaft). Alternatively, the camshaft 12 could also form what is referred to as an SOHC system (single overhead camshaft). In other embodiments, the camshaft 12 can also be arranged as a bottom-mounted camshaft.

The cam carrier 14 is arranged for conjoint rotation on the camshaft 12. In addition, the cam carrier 14 is arranged so as to be axially movable along a longitudinal axis of the camshaft 12. The cam carrier 14 can be movable axially between a first stop 28 and a second stop 30.

The cam carrier 14 is described below with reference to FIGS. 1 to 4. The cam carrier 14 has three cams 32, 34 and 36, which are offset from one another in a longitudinal direction of the cam carrier 14 and of the camshaft 12. The first cam 32 is arranged at a first end of the cam carrier 14 and is designed for a normal mode, as described in detail by way of example further on. The second cam 34 is arranged adjacent to the first cam 32 and is designed for an engine braking mode, as likewise described in detail by way of example further on. The third cam 36 is arranged at a distance from the second cam 34 and the second end of the cam carrier 14. The third cam 36 is designed for the normal mode. The third cam 36 is shaped in the manner of the first cam 32.

The cam carrier 14 also has a first cam-less section 38 and a second cam-less section 40. The first cam-less section 38 is arranged at the second end of the cam carrier 14. The second cam-less section 40 is arranged between the second cam 34 and the third cam 36. A first engagement track (shift slot) 42 extends in a spiral around a longitudinal axis of the cam carrier 14 in the first cam-less section 38. A second engagement track (shift slot) 44 extends in a spiral around the longitudinal axis of the cam carrier 14 in the second cam-less section 40.

To move the cam carrier 14 between the stops 28 and 30, the actuators 24 and 26 (FIGS. 1 and 2) can engage selectively in the engagement tracks 42, 44 by means of extendable elements (not shown in detail). In particular, the first actuator 24 can engage selectively in the first engagement track 42 to move the cam carrier 14 from one axial position to another axial position. In a first axial position, the cam carrier 14 rests against the second stop 30. In a second axial position, the cam carrier 14 rests against the first stop 28. In FIGS. 1 to 4, the cam carrier is illustrated in the first axial position. The second actuator 26, in turn, can engage selectively in the second engagement track 44. The cam carrier 14 is then moved from the first axial position to the second axial position.

The movement is triggered by the fact that the extended element of the respective actuator 24, 26 is fixed in relation to an axial direction of the camshaft 12. Consequently, the movable cam carrier 14 is moved in a longitudinal direction of the camshaft 12 owing to the spiral shape of the engagement tracks 42, 44 when the extended element engages in the respective engagement track 42, 44. At the end of the process of movement, the movable element of the respective actuator 24, 26 is guided counter to the direction of extension by the respective engagement track 42, 44 and is thus retracted. The movable element of the respective actuator 24, 26 disengages from the respective engagement track 42, 44.

The first transmission device 16 and the second transmission device 18 (FIGS. 1 and 2) establish an operative connection between the cam carrier 14 and the exhaust valves 20, 22. The first exhaust valve 20 is actuated (opened) when the first cam 32 or the second cam 34 presses the first transmission device 16 downwards. The second exhaust valve 22 is actuated (opened) when the third cam 36 presses the second transmission device 18 downwards.

When the cam carrier 14 is in the first axial position (as shown in FIGS. 1 to 4), the first transmission device 16 is in operative connection between the first cam 32 and the first exhaust valve 20. In other words, the first transmission device 16 is not in operative connection between the second cam 34 and the first exhaust valve 20 in the first axial position of the cam carrier 14. The first exhaust valve 20 is actuated in accordance with a contour of the first cam 32. In the second axial position of the cam carrier 14, the first transmission device 16 is in operative connection between the second cam 34 and the first exhaust valve 20. The first exhaust valve 20 is actuated in accordance with a contour of the second cam 34.

In the first axial position of the cam carrier 14, the second transmission device 18 is in operative connection between the third cam 36 and the second exhaust valve 22. The second exhaust valve 22 is actuated in accordance with a contour of the third cam 36. In the second axial position of the cam carrier 14, the second transmission device 18 does not actuate the second exhaust valve 22. In the second axial position of the cam carrier 14, a contact region 18A of the second transmission device 18 lies at the same axial position with respect to the camshaft 12 as the first cam-less section 38. The first cam-less section 38 does not have a raised portion for actuating the second transmission device 18. If the cam carrier 14 is in the second axial position, the second exhaust valve 22 is not actuated.

The first cam-less section 38 therefore has two functions. Firstly, the first cam-less section 38 receives the first guide track 42. Secondly, the first cam-less section 38 serves to the effect that the second exhaust valve 42 is not actuated in the second axial position of the cam carrier 14. This integration of functions is favourable for construction space reasons.

In the illustrated embodiment, the first transmission device 16 and the second transmission device 18 are each designed as a finger follower. In other embodiments, the transmission devices 16 and 18 can be designed as rockers or tappets. In some embodiments, the transmission devices 16 and 18 can have cam followers, for example in the form of rotatable rollers.

Figure 4:
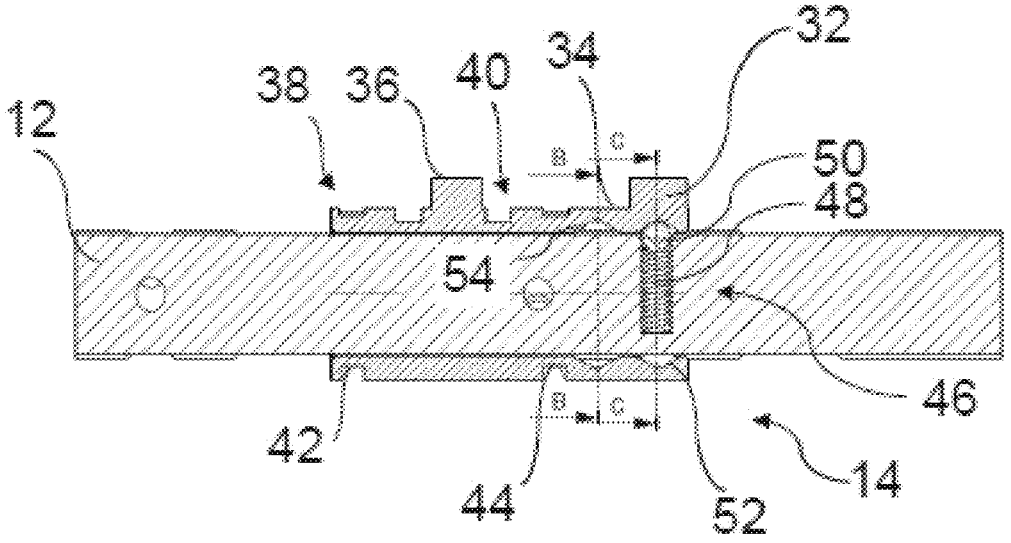
FIG. 4 shows a longitudinal sectional view of the camshaft from FIG. 3 along the line A-A.

With reference to FIG. 4, a locking device 46 is shown. The locking device 46 has an elastic element 48 and a catch 50. The elastic element 48 is arranged in a blind hole of the camshaft 12. The elastic element 48 preloads the catch 50 against the cam carrier 14. A first and second recess 52 and 54 are arranged in an inner circumferential surface of the cam carrier 14. To lock the cam carrier 14, the catch 50 is pressed into the first recess 52 when the cam carrier 14 is in the first axial position. In the second axial position of the cam carrier 14, the catch 50 is pressed into the second recess 54.

The control of the first exhaust valve 20 and the effect thereof on a cylinder pressure are described below with reference to FIG. 5. FIG. 4 shows a complete four-stroke cycle comprising compression, expansion, exhaust and induction.

Curve A describes the profile of the cylinder pressure when the second cam 34 is in operative connection with the first exhaust valve 20. In other words, curve A shows the profile of the cylinder pressure during engine braking. Curve B shows the profile of the valve lift of the first exhaust valve 20 when the first cam 32 is in connection with the first exhaust valve 20 (i.e. during the normal mode). The third curve C shows the profile of the valve lift of an inlet valve both during the normal mode and in the engine braking mode. Curve D shows the profile of the valve lift of the first exhaust valve 20 when the second cam 34 is in operative connection with the first exhaust valve 20.

Curve B shows that the exhaust valve is open during the exhaust stroke in the normal mode. Curve C shows that the inlet valve is open during the induction stroke (inlet stroke) in the normal mode and in the braking mode.

Curve D shows that the exhaust valve is opened slightly at the end of the compression stroke in the region of the top dead centre at around 60° crank angle to 100° crank angle before the top dead centre. At the top dead centre, the exhaust valve is opened further and closes at the end of the expansion stroke, approximately at the bottom dead centre. The opening of the exhaust valve at the end of the compression stroke has the effect that the compressed air in the cylinder is forced through the open exhaust valve into the exhaust system by the piston moving towards the top dead centre. The compression work previously performed brakes the crankshaft and thus the internal combustion engine. The cylinder pressure initially rises in the compression stroke, but then falls even before the top dead centre owing to the opening of the exhaust valve (cf. curve A). The open exhaust valve during the expansion stroke has the effect that air is sucked back into the cylinder from the exhaust lines. At the end of the expansion stroke, the cylinder is substantially filled with air from the exhaust system.

Curve D also shows that the exhaust valve initially remains closed after the bottom dead centre is reached at the end of the expansion stroke. At the end of the exhaust stroke, the exhaust valve opens in the region of the top dead centre. Once again, opening takes place at around 60° crank angle to 100° crank angle before the top dead centre. The closed exhaust valve during the first portion of the exhaust stroke has the effect that the air drawn in in the expansion stroke is compressed with the performance of work. The cylinder pressure rises (curve A). The compression work brakes the crankshaft and thus the internal combustion engine. The opening of the exhaust valve at the end of the exhaust stroke has the effect that the air is forced into the exhaust system through the open exhaust valve. In the induction stroke, the cylinder is refilled with air through the open inlet valve or inlet valves (curve C). The cycle begins again.

As explained above, the use of the second cam leads to the control of the exhaust valve for a double compression with subsequent decompression, thus providing an engine braking functionality.

As is obvious from a comparison of curves B and D, the valve lift of the exhaust valve in the braking mode (curve D) is less than in the normal mode (curve B). Moreover, the valve lift during the opening of the exhaust valve in the compression and expansion stroke has two stages. These measures have the effect that the load on the variable valve gear in the braking mode is reduced since high loads on the valve gear can occur owing to the opening of the exhaust valve counter to the pressure in the cylinder.

Figure 6A:
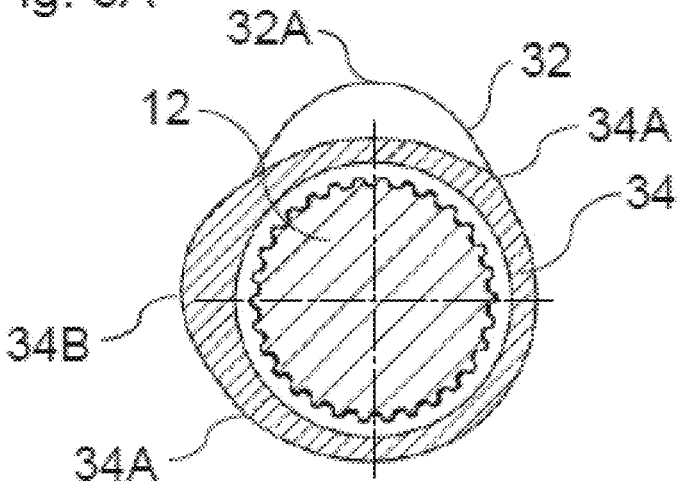
FIG. 6A shows a first cross-sectional view of the camshaft from FIG. 4 along the line B-B.
Figure 6B:
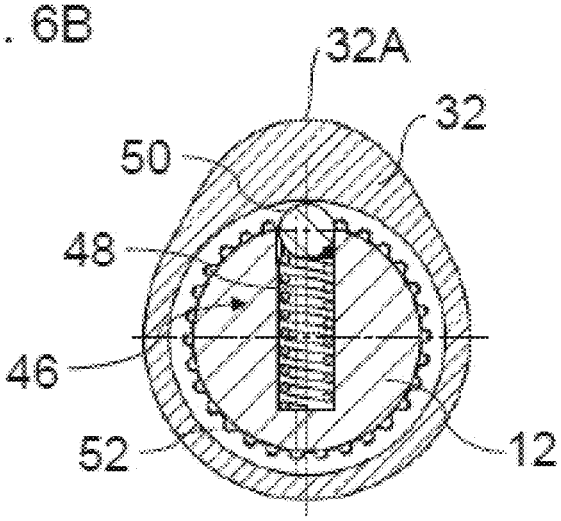
FIG. 6B shows a second cross-sectional view of the camshaft from FIG. 4 along the line C-C.

FIG. 6A shows a cross section through the second cam 34. FIG. 6B shows a cross section through the first cam 32.

Figure 5:
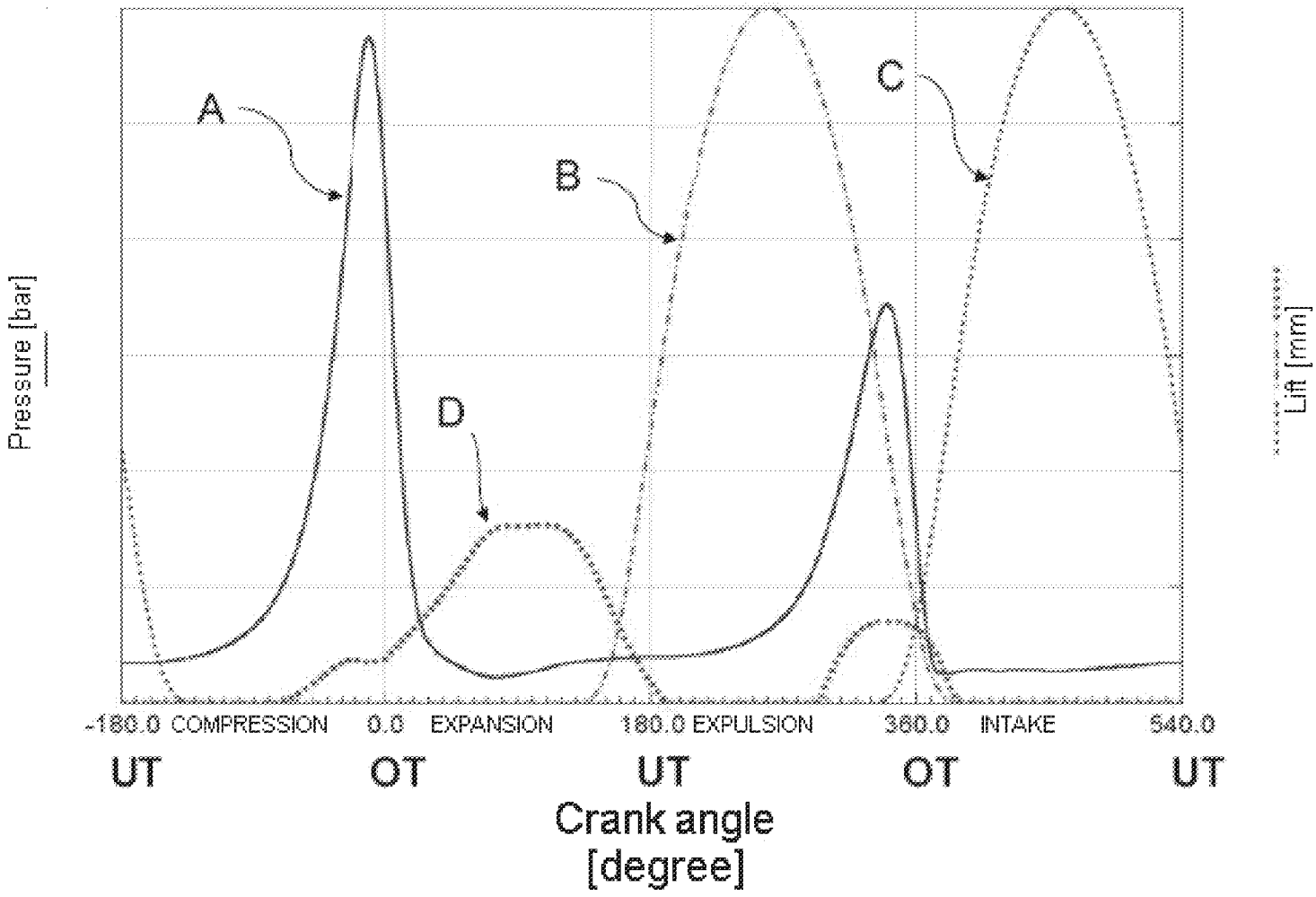
FIG. 5 shows an exemplary valve control diagram of the variable valve gear.

The second cam 34 is designed for achieving the curve D from FIG. 5. For this purpose, the second cam 34 in particular has a first raised portion 34A, a second raised portion 34B and a third raised portion 34C. The first, second and third raised portions 34A-34C are arranged offset in the circumferential direction about the second cam 34. The first raised portion 34A leads to the opening of an exhaust valve at the end of the compression stroke. The second raised portion 34B, which extends from the first raised portion 34A, leads to an expanded opening of an exhaust valve during the expansion stroke. The third raised portion 34C leads to opening of an exhaust valve at the end of the exhaust stroke.

The first raised portion 34A has the smallest height of the raised portions 34A-34C, as measured in a radial direction of the camshaft 12. The second raised portion 34B has the greatest height of the raised portions 34A-34C, as measured in a radial direction of the camshaft 12. The third raised portion 34C is smaller than the second raised portion 34B and larger than the first raised portion 34A. Different heights of the raised portions 34A-34C lead to correspondingly different valve lifts (cf. FIG. 5).

The first, second and third raised portion 34A-34C is in each case arranged offset circumferentially with respect to a raised portion 32A of the first cam 32. The first cam 32 is designed for achieving the curve B from FIG. 5. The raised portion 32A of the first cam 32 leads to opening of an exhaust valve during the exhaust stroke. The raised portion 32A is higher than the raised portions 34A-34C, as measured in a radial direction of the camshaft 12. The valve lift by means of the raised portion 32A is greater than by means of the raised portions 34A-34C.

FIG. 6B also shows the locking device 46 with the elastic element 48, the catch 50 and the first recess 52.

The invention is not restricted to the preferred exemplary embodiments described above. On the contrary, a large number of variants and modifications is possible which likewise make use of the inventive concept and therefore fall within the scope of protection. In particular, the invention also claims protection for the subject matter and the features of the dependent claims independently of the claims to which they refer.

LIST OF REFERENCE SIGNS

10 variable valve gear
12 camshaft
14 cam carrier
16 first transmission device (first finger follower)
18 second transmission device (second finger follower)
20 first exhaust valve
22 second exhaust valve
24 first actuator
26 second actuator
28 first stop
30 second stop
32 first cam
34 second cam
36 third cam
38 first cam-less section
40 second cam-less section
42 first engagement track
44 second engagement track
46 locking device
48 elastic element
50 catch
52 first recess
54 second recess
A cylinder pressure
B exhaust valve timing curve in the normal mode
C inlet valve timing curve
D exhaust valve timing curve in the braking mode

The invention claimed is:

1. A variable valve gear for an internal combustion engine of a motor vehicle, comprising:

a first exhaust valve;

a camshaft;

a cam carrier which is arranged on the camshaft in a manner which prevents relative rotation and allows axial movement between a first axial position and a second axial position and has a first cam and a second cam, wherein the first cam and the second cam are arranged offset in a longitudinal direction of the camshaft; and a first transmission device which, in the first axial position of the cam carrier, is in operative connection between the first cam and the first exhaust valve, and, in the second axial position of the cam carrier, is in operative connection between the second cam and the first exhaust valve;

wherein the first cam is configured for a normal mode of the internal combustion engine, in which the first cam keeps the first exhaust valve open in an exhaust stroke; and the second cam is configured for an engine braking mode of the internal combustion engine, in which the second cam initially keeps the first exhaust valve closed in a compression stroke and opens the first exhaust valve before reaching a top dead center of a piston movement, and/or in which the second cam initially keeps the first exhaust valve closed in the exhaust stroke and opens the first exhaust valve before reaching a top dead center of a piston movement.

2. The variable valve gear according to claim 1, wherein the cam carrier has a third cam which is configured in the manner of the first cam and has a cam-less section, wherein the first cam, the second cam, the third cam and the cam-less section are arranged offset in a longitudinal direction of the camshaft.

3. The variable valve gear according to claim 2, further comprising:

a second exhaust valve; and a second transmission device which, in the first axial position of the cam carrier, is in operative connection between the third cam and the second exhaust valve, and, in the second axial position of the cam carrier, keeps the second exhaust valve closed because of the design of the cam-less section.

4. The variable valve gear according to claim 3, wherein:

the second exhaust valve is assigned to a same cylinder as the first exhaust valve.

5. The variable valve gear according to claim 2, wherein:

the first cam is adjacent to the second cam, and/or the third cam is adjacent to the cam-less section.

6. The variable valve gear according to claim 1, further comprising a second exhaust valve, wherein, in the first axial position of the cam carrier, the first transmission device is additionally in operative connection between the first cam and the second exhaust valve and, in the second axial position, is additionally in operative connection between the second cam and the second exhaust valve.

7. The variable valve gear according to claim 6, wherein:

the second exhaust valve is assigned to a same cylinder as the first exhaust valve.

8. The variable valve gear according to claim 1, wherein the cam carrier has a first engagement track for axially moving the cam carrier in a first direction.

9. The variable valve gear according to claim 8, wherein the first engagement track is arranged in the cam-less section.

10. The variable valve gear according to claim 8, wherein the first engagement track and/or the cam-less section is arranged between the first cam and the third cam or at one end of the cam carrier.

11. The variable valve gear according to claim 10, wherein the cam carrier has a second engagement track for axially moving the cam carrier in a second direction which is opposed to the first direction, wherein the second engagement track is arranged between the first cam and the third cam or at one end of the cam carrier.

12. The variable valve gear according to claim 11, further comprising:

a first actuator configured to engage selectively with the first engagement track to move the cam carrier in the first direction; and/or a second actuator which configured to engage selectively with the second engagement track to move the cam carrier in the second direction.

13. The variable valve gear according to claim 11, wherein:

the second engagement track extends in a spiral.

14. The variable valve gear according to claim 8, wherein:

the first engagement track extends in a spiral.

15. The variable valve gear according to claim 1, wherein the camshaft has a catch which, in the first axial position of the cam carrier, is configured to engage in a first recess in the cam carrier, and, in the second axial position of the cam carrier, is configured to engage in a second recess in the cam carrier.

16. The variable valve gear according to claim 1, wherein the first transmission device and/or the second transmission device comprises a lever selected from a group consisting of a rocker, a finger follower, or a tappet.

17. The variable valve gear according to claim 1, wherein:

the camshaft is arranged as an overhead camshaft or a bottom-mounted camshaft; and/or the camshaft is part of a double camshaft system which includes a further camshaft for actuating at least one inlet valve.

18. The variable valve gear according to claim 1, wherein the second cam is configured such that:

the first exhaust valve opens between 100° crank angle and 60° crank angle before the top dead center is reached; and/or after the opening in the exhaust stroke, the first exhaust valve closes in the region between the top dead center and 30° crank angle after the top dead center; and/or after the opening in the compression stroke, the first exhaust valve closes in the region between the bottom dead center and 30° crank angle after the bottom dead center.

19. The variable valve gear according to claim 1, wherein the second cam is configured such that:

after the opening in the compression stroke, the first exhaust valve is opened with a greater valve lift than after the opening in the exhaust stroke; and/or the first exhaust valve is opened with a smaller valve lift than in the case of the first cam.

20. A commercial motor vehicle having a variable valve gear for an internal combustion engine, the variable valve gear comprising:

a first exhaust valve;

a camshaft;

a cam carrier which is arranged on the camshaft in a manner which prevents relative rotation and allows axial movement between a first axial position and a second axial position and has a first cam and a second cam, wherein the first cam and the second cam are arranged offset in a longitudinal direction of the camshaft; and a first transmission device which, in the first axial position of the cam carrier, is in operative connection between the first cam and the first exhaust valve, and, in the second axial position of the cam carrier, is in operative connection between the second cam and the first exhaust valve;

wherein the first cam is configured for a normal mode of the internal combustion engine, in which the first cam keeps the first exhaust valve open in an exhaust stroke; and the second cam is configured for an engine braking mode of the internal combustion engine, in which the second cam initially keeps the first exhaust valve closed in a compression stroke and opens the first exhaust valve before reaching a top dead center of a piston movement, and/or in which the second cam initially keeps the first exhaust valve closed in the exhaust stroke and opens the first exhaust valve before reaching a top dead center of a piston movement.

* * * * *